US005746058A

United States Patent [19]

Vertanen

[11] Patent Number: 5,746,058

[45] Date of Patent: May 5, 1998

[54] ADJUSTABLE ACTUATOR FOR A TURBOCHARGER

[75] Inventor: Mark W. Vertanen, Creston, Iowa

[73] Assignee: Gits Manufacturing Company, Creston, Iowa

[21] Appl. No.: 613,496

[22] Filed: Mar. 11, 1996

[51] Int. Cl.[6] ..... F02B 37/12

[52] U.S. Cl. ..... 60/602; 92/161; 248/299.1

[58] Field of Search ..... 60/602; 92/161; 248/299.1, 346.06

[56] References Cited

U.S. PATENT DOCUMENTS

| | | | |
|---|---|---|---|
| 3,153,988 | 10/1964 | Warstler | 92/161 |
| 4,098,085 | 7/1978 | McDowell | 60/600 |
| 4,171,936 | 10/1979 | Hageman et al. | 417/407 |
| 4,245,953 | 1/1981 | Milton et al. | 415/144 |
| 4,256,019 | 3/1981 | Braddick | 60/602 |
| 4,463,564 | 8/1984 | McInerney | 60/602 |
| 4,499,732 | 2/1985 | Szczupak et al. | 60/602 |
| 4,745,753 | 5/1988 | Tadokoro et al. | 60/602 |
| 5,046,317 | 9/1991 | Satokawa | 60/602 |
| 5,172,552 | 12/1992 | Elpern et al. | 60/602 |
| 5,205,125 | 4/1993 | Potter | 60/602 |
| 5,214,919 | 6/1993 | Jiewertz | 60/602 |
| 5,231,831 | 8/1993 | Leavesley | 60/602 |
| 5,267,829 | 12/1993 | Schmidt et al. | 415/48 |
| 5,269,144 | 12/1993 | Miller et al. | 60/609 |
| 5,322,255 | 6/1994 | Garrett | 248/299.1 |

FOREIGN PATENT DOCUMENTS

| | | | |
|---|---|---|---|
| 60-53622 | 3/1985 | Japan | 60/602 |
| 688358 | 3/1953 | United Kingdom | 248/299.1 |
| 2151700 | 7/1985 | United Kingdom | 60/602 |

*Primary Examiner*—Michael Koczo

*Attorney, Agent, or Firm*—Zarley, McKee, Thomte, Voorhees, & Sease

[57] ABSTRACT

An adjustable actuator for a waste gate exhaust valve of a turbocharger includes a housing having a first opening therein for communication with the pressure outlet of the turbocharger and a second opening therein remote from the first opening. The actuator also includes a rod interconnecting the housing and the waste gate exhaust valve through the second opening. The actuator further includes a pivotal mounting bracket connected to the housing adjacent the second opening. One or more flange portions extend radially outward from a central body portion which has an aperture therein for receiving the rod. The actuator also includes a fastener for selectively clamping the bracket to the housing such that the bracket can rotate and tilt with respect to housing when the fastener is loosened and is held in a fixed positioned once the fastener is tightened. The actuator utilizes a flat elastic diaphragm at a seam between two portions of the house to divide it into first and second chambers respectively and provide increased durability. One of the spring guides for mounting the rod assembly to the housing can be threaded into the housing so as to provide axial adjustment, which translates into a change to the preload on the spring and thereby the boost pressure setting of the turbocharger.

11 Claims, 2 Drawing Sheets

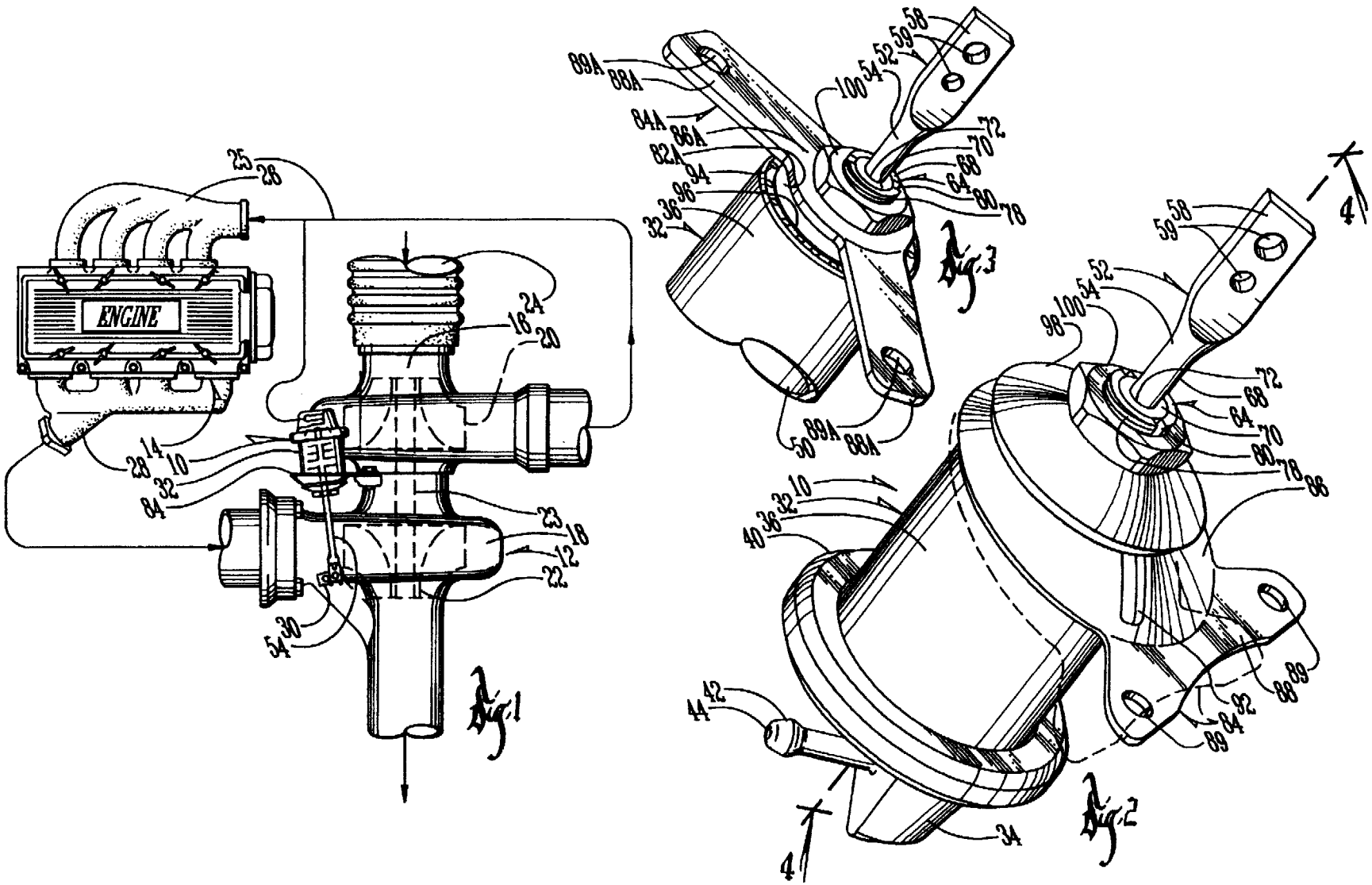
ENGINE

ADJUSTABLE ACTUATOR FOR A TURBOCHARGER

BACKGROUND OF THE INVENTION

The present invention relates to internal combustion engines, more particularly to turbochargers used to boost the performance of such engines. In particular, this invention provides a durable and adjustable actuator for controlling the waste gate valve of a turbocharger and thereby adjusting the flow of air through the turbocharger.

Turbochargers are old in the automotive and truck art. Typically, turbochargers have a compressor with one or more turbines for raising or "boosting" the pressure of air fed to the engine. The flow of air through the compressor and the boost pressure is modulated by an exhaust waste gate valve controlled by an actuator.

Various types of actuators for turbochargers are also known in the art. One type of actuator is mounted external to the compressor housing and utilizes a diaphragm molded from an elastic material. The diaphragm is positioned in the actuator housing with one side in communication with the waste outlet pressure, while the other side engages a spring-loaded actuating rod assembly connected to the waste gate valve of the turbocharger. Heretofore such diaphragms have been designed with deep or complex convoluted configurations on the assumption that they experience large scale movements and a structure must be provided to accommodate such movements. These convoluted diaphragms are costly to manufacture. Furthermore, the durability of the diaphragm is a factor in determining the useful life of the actuator assembly.

Another shortcoming of existing actuator assemblies is that each assembly must be custom or tailor-designed to mount to a particular engine and turbocharger. A multitude of manufacturers offer many different engine and turbocharger configurations. The spatial relationship between the inlet and outlet of the turbocharger compressor varies depending on the configuration. This has prevented any actuator design for universal application.

More particularly, a unique mounting bracket must be fabricated to attach the actuator to each respective type of turbocharged engine. This lack of standardization means lower quantity machining and assembly production runs, higher inventory costs, and ultimately higher total production costs. A similar problem is encountered when various turbocharger boost pressure settings are required. In order to accommodate the various turbocharger designs, a proliferation of dedicated components requiring assembly, disassembly and shimming, are available to adjust the pressure settings. A more cost-effective convenient way to set the boost pressure of the turbocharger would be appreciated on the assembly lines and in the field.

Different engines also require different radial timing of the inlet port or stem on the actuator housing that connects to the exhaust outlet. Thus, the actuator manufacturers must use different actuator housings or portions thereof to provide the necessary radial flexibility. More often than not, this involves added expense for assembly or an increased number of actuator housings. The increased number of actuator housings necessitates a greater number of expensive dies or molds for making them.

Finally, the attitude of existing actuators with respect to the actuator rod is fixed. Greater mounting flexibility might be achieved if the attitude or tilt of the actuator housing could be varied with respect to the turbocharger. Thus, a single actuator assembly covering a broader range of applications is desirable.

Therefore, a primary objective of the present invention is the provision of an adjustable actuator for a turbocharged engine.

Another objective of the present invention is the provision of an improved actuator which is universal in operative connection to turbochargers having various configurations.

A further objective of this invention is the provision of an actuator assembly having an externally accessible mechanism for adjusting the turbocharger boost pressure.

A further objective of this invention is the provision of an actuator assembly wherein the stem and inlet port therein is radially adjustable with respect to the actuator rod.

A further objective of this invention is the provision of an actuator assembly wherein the attitude of the actuator housing relative to the turbocharger is adjustable.

A further objective of this invention is the provision of an actuator assembly wherein the diaphragm is flat and thereby more durable than existing actuators.

These and other objects of the present invention will be apparent from the drawings, description and claims which follow.

SUMMARY OF THE INVENTION

The present invention is an actuator for a waste gate exhaust valve of a turbocharger. The actuator of this invention is adjustable to provide various mounting positions and is also adjustable in terms of the boost pressure setting. The actuator includes a housing having a first opening therein for communication with the pressure outlet of the turbocharger, and a second opening therein remote from the first opening. The actuator includes a rod which extends through the second opening to interconnect the housing and the waste gate exhaust valve. The actuator further includes a pivotal mounting bracket connected with the housing adjacent the second opening. The bracket has an aperture for receiving the rod. The actuator includes a fastener for selectively securing the bracket to the housing. With the fastener loosened, the bracket can pivot with respect to the housing. With the fastener tightened, the bracket is held in a fixed positioned with respect to the housing. Thus the bracket can be rotated 360° about the axis of the rod with respect to the bracket, and can be tilted to various attitudes relative to the housing.

In one embodiment of the present invention, the mounting bracket is concave to mate with a convex surface on the bottom of the housing. Thus, when the fastener is loosened, the mounting bracket can be pivoted both radially and angularly with respect to the housing.

In another embodiment of the present invention, the bottom of the actuator housing and the bracket are flat. The flat bracket has a body portion and two generally opposing flanges which extend radially outward from the body portion. The body portion has a diameter small enough to permit venting through uncovered portions of the housing bottom. Furthermore, the flanges are angularly spaced and narrow enough not to obstruct the venting of the actuator through the housing bottom. This embodiment provides for radial adjustment or indexing of the mounting bracket to meet mounting various requirements.

Another aspect of the present invention is that a flat elastic diaphragm is clamped between first and second housing portions at a seam. The diaphragm extends across the seam, dividing the housing into first and second chambers respectively. The flat diaphragm is engaged by a spring-operated actuating rod assembly which includes the rod. The rod extends through an opening in the second housing portion. The rod has a compression coil spring mounted thereon for establishing a preload on the diaphragm. The flat diaphragm is particularly well-suited for small movements (generally around 0.150" or less) and provides significantly longer life than existing convoluted diaphragms utilized in turbocharger actuator applications.

Another aspect of the present invention is a provision of an actuator having an adjustable boost pressure. Threaded adjustment means are provided between the housing and the internal spring on the rod to adjust the preload on the spring, and thereby adjust the turbocharger boost pressure of the actuator.

BRIEF DESCRIPTION OF THE DRAWINGS

FIG. 1 is a simplified schematic diagram showing the actuator of the present invention applied to the turbocharger of an engine.

FIG. 2 is a perspective view of a first embodiment of the actuator of the present invention.

FIG. 3 is a partial perspective view of a second embodiment of the present invention, which has an alternate mounting bracket configuration.

DETAILED DESCRIPTION OF THE PREFERRED EMBODIMENTS

Figures 4, 5, 6, 7:
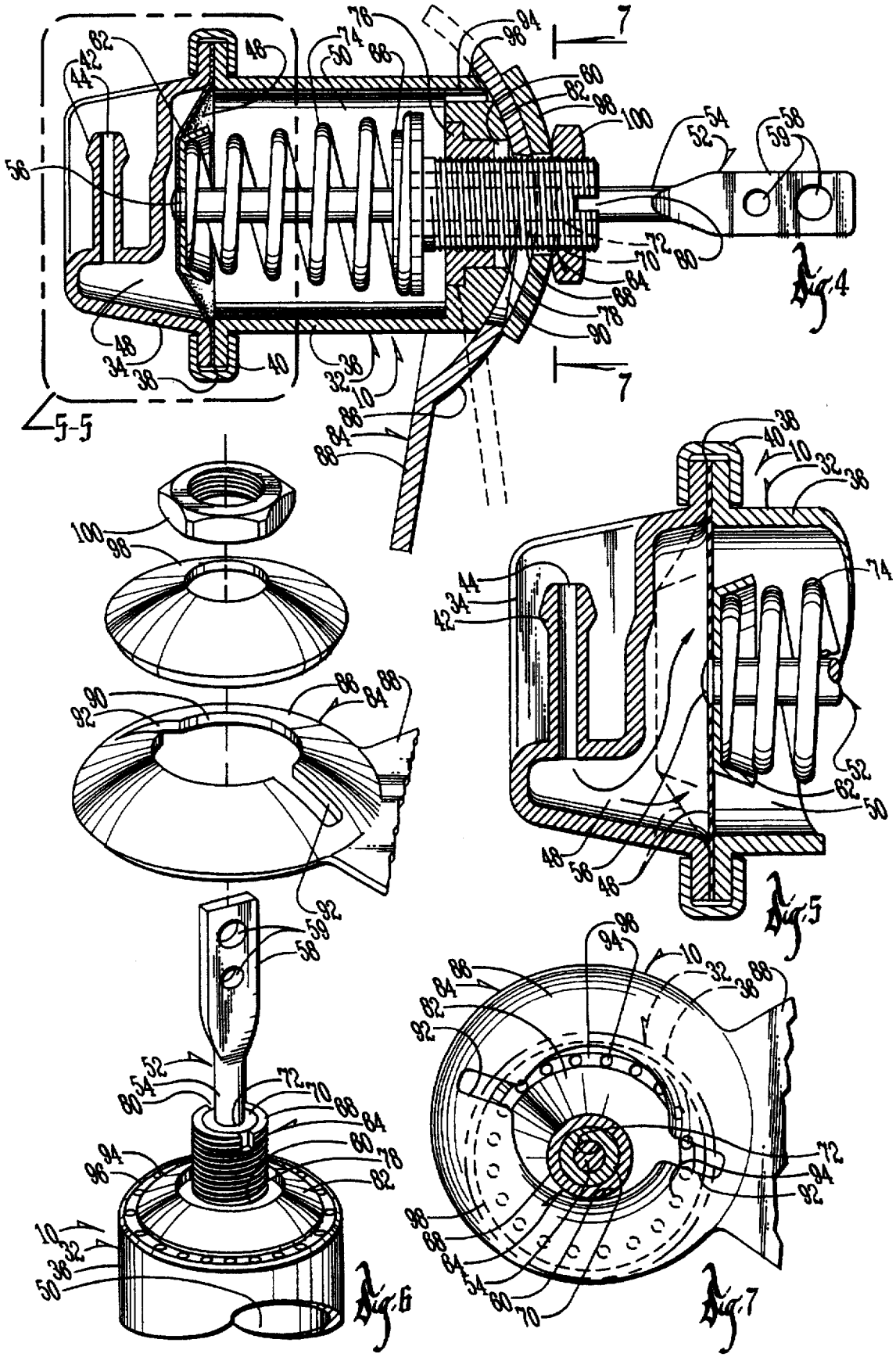
FIG. 4 is a cross-sectional view of the first embodiment of the actuator taken along line 4—4 in FIG. 2.
FIG. 5 is an enlarged sectional view of the first embodiment taken along line 5—5 in FIG. 4.
FIG. 6 is a partial exploded assembly view of the actuator of FIG. 2 showing the adjustable mounting bracket assembly of the present invention.
FIG. 7 is a cross-sectional view taken along line 7—7 of FIG. 4 showing how the adjustable mounting bracket in the present invention maintains venting from the lower portion of the housing.

In the figures, the actuator of the present invention is denoted by the reference numeral 10. In FIG. 1, the actuator 10 mounts to a turbocharger 12 on a conventional truck or automotive engine 14. The turbocharger 12 includes a compressor housing 16, an exhaust housing 18, and an inlet compressor 20 and an outlet turbine 22 connected by a rotor 23. Low pressure air is directed through the inlet 24 of the turbocharger and has its pressure raised by the inlet compressor 20. This higher pressure air is then sent via a pressure outlet passage or line 25 to the inlet manifold 26 of the engine 14 for combination with the fuel and subsequent combustion. The engine 14 also includes an exhaust manifold 28 which directs exhaust to the exhaust turbine 22 in the exhaust housing 18. An exhaust waste gate valve 30 is disposed within the exhaust housing 18 just upstream of the exhaust turbine 22. The waste gate valve 30 causes the flow of exhaust gas to bypass the exhaust turbine 22 and subsequently slows the rotation of the inlet turbine 20 by the rotor 23. Thus, the waste gate valve 30 effectively lowers the output pressure generated by the inlet compressor 20 when the valve 30 opens.

The actuator 10 of the present invention mechanically attaches to and operates the waste gate exhaust valve 30. The actuator 10 is also fluidly connected to the inlet manifold 26 and thereby to the pressure outlet passage 25 of the inlet compressor 20, as seen in FIG. 1. The actuator 10 moves or opens and closes the waste gate exhaust valve 30 in response to the pressure sensed at the inlet manifold 26 and the passage 25. Thus, the actuator 10 effectively maintains a boost pressure by opening or closing the waste gate exhaust valve 30, which controls the flow of exhaust gas allowed to bypass the exhaust turbine 22.

One embodiment of the actuator 10 of the present invention is shown in FIG. 2. The actuator 10 includes a housing 32 having first and second housing portions 34, 36 joined at a seam 38 by a collar ring 40. Preferably the collar ring 40 is crimped onto the housing 32 so as to fix the housing portions 34 and 36 together at the seam 38. The upper housing portion 34 includes a stem 42 protruding therefrom which has an inlet port or opening 44 therein.

Referring to FIG. 4, a diaphragm 46 is clamped between the first and second housing portions 34, 36 at the seam 38. The diaphragm 46 extends across the seam 38 and divides the housing 32 into first and second chambers 48, 50 respectively. The diaphragm 46 is constructed of an elastic material, such as Epichlorohydrin Flurosilcone, normally flat in an unloaded, free state or at rest (see FIG. 5). The diaphragm 46 will distend in response to fluid and mechanical pressure thereon.

An actuating rod assembly 52 interconnects the housing 32 of the actuator 10 with the waste gate exhaust valve 30, as shown in FIG. 1. The rod assembly 52 includes an elongated rod 54 having first and second ends 56 and 58, respectively. The first end 56 of the rod 54 is inserted in a second opening 60 in the second portion 36 of the housing 32 remote from the seam 38. Thus, the first end 56 of the rod 54 is disposed inside the second chamber 50 of the housing 32. One or more mounting holes 59 are provided in the second end 58 of the rod 54. The holes 59 allow the rod 54 of the actuator 10 to be mechanically connected by conventional means to the waste gate exhaust valve 30 of the turbocharger 12.

The first end 56 of the rod 54 has a first spring guide or cap 62 attached thereto. A second spring guide 64 slidably mounts on the rod 54 between the first and second ends 54, 58. The spring guide 64 has a head 66 and a shaft or stud 68. The second spring guide 64 has a rod guide bushing 70 which extends into the shaft 68 and has a hole 72 therethrough which guidingly and slidingly receives the rod 54.

The head 66 of the second spring guide 64 is adapted to guidingly engage a compression spring 74. The compression spring 74 is of the coiled type, and is preferably conical. As best seen in FIG. 4, the spring 74 is captured and guided between the spring guides 62, 64. The preload on the spring 74 normally urges the spring guide 62 into engagement with the diaphragm 46.

The preload of the spring 74 is established by the axial position of the head 66 with respect to the second housing portion 36. A union 76 is press fitted or otherwise suitably attached across the second opening 60 and prevented from rotating with respect to the housing 32. The union 76 has a stepped outer diameter and a threaded inside diameter which matingly engages threads 78 on the shaft 68. One or more slots 80 on the end of the shaft 68 opposite the head 66 allow the second spring guide 64 to be rotated relative to the housing 32 with a suitable complementary tool. Preferably the two slots 80 diametrically oppose each other at the end of the shaft 68. The preload on the spring 74 increases when the second spring guide 64 is turned so as to extend farther into the second chamber 50. The preload on the spring 74 decreases when the second spring guide 64 is turned in the opposite direction. The preload force of the spring 74 must be overcome by the pressure of the inlet port 44 before the diaphragm 46 can move the rod 54 to actuate the waste gate exhaust valve 30 (see FIGS. 1, 4 and 5).

As best seen in FIGS. 2, 4, and 6, a pivotal mounting bracket 84 engages or connects with the housing 32 adjacent the second opening 60. The mounting bracket 84 has a body portion 86 which is positioned adjacent the bottom 82 of the housing 32 and a flange portion 88 which extends outward from the body portion 86. The body portion 86 includes an aperture therein for receiving the rod 54 and the shaft 68 of the second spring guide 64. In order to allow angular adjustments to the attitude of the bracket 84 relative to the housing 32, the aperture 90 is substantially larger than the diameter of the shaft or stud 68 which extends from the housing 32. In the embodiment shown in FIGS. 2, 4, 6, and 7, the bottom 82 of the housing 32 is convex. The mounting bracket 84 has a complementary shape. In other words, the bracket 84 has an upper surface that is concave so as to mate with the bottom 82 of the housing 32. The mounting bracket 84 further includes a pair of opposing radial slots 92 which extend radially outward from the aperture 90.

The housing bottom 82 has a plurality of vent holes 94 therethrough into the second chamber 50 of the housing 32. Preferably a groove 96 in the housing bottom 82 interconnects the vent holes 94 to better ensure adequate venting, as can be understood in view of FIG. 7. The mounting bracket 84 ensures that the aperture 90 or the slots 92 overlap at least one of the vent holes 94 or the groove 96.

A washer 98 and a nut 100 hold the pivotal mounting bracket 84 in place on the rod 54 and against the bottom 82 of the housing 32. The washer 98 preferably has a shape similar to the body portion 86 of the pivotal mounting bracket 84.

A nut 100 is threaded onto the threads 78 of the shaft 68. The mounting bracket 84 is held tightly in place and cannot pivot once the nut 100 is tightened. However, when the nut 100 is loosened, the mounting bracket 84 can pivot radially about the rod 54 and the housing 32, as best seen in FIG. 2. Furthermore, as best seen in FIGS. 4 and 7, the mounting bracket 84 of this invention can also be pivoted angularly or have its attitude angularly adjusted with respect to the rod 54 and the housing 32. FIG. 4 shows that the pivot bracket 84 has been moved from the attitude shown by dashed lines to the attitude shown by solid lines. These kinds of adjustments are particularly useful in making the actuator 10 of this invention universally mountable to the waste gate exhaust valve 30 on a variety of different types of turbochargers.

Another embodiment of the present invention is shown in FIG. 3. In this embodiment, a pivotal mounting bracket 84A is connected with a flat bottom 82A of the housing 32. This embodiment merely provides adjustment in a radial direction with respect to the housing 32. Therefore, the washer can be flat, omitted, or integrated into the pivotal mounting bracket 84A. The pivotal mounting bracket 84A can be radially indexed from one position to another when the nut 100 is loosened. The body portion 86A of the pivotal mounting bracket 84A has an outside diameter that is small enough not to interfere with the vent holes 94 and the groove 96. Furthermore, the width and angular spacing between the flange portions 88A ensures that at least some of the vent holes 94 are always left uncovered. One or more mounting holes 89 extend through the flange portion 88 of the pivotal mounting bracket 84 as shown in FIG. 2.

It will be appreciated that the present invention can take many forms and embodiments. The true essence and spirit of this invention are defined in the appended claims, and it is not intended that the embodiment of the invention presented herein should limit the scope thereof.

What is claimed is:

1. An adjustable actuator for a turbocharger having a pressure outlet, an exhaust outlet, and a waste gate exhaust valve fluidly connected with exhaust outlet, comprising:

a housing having a first opening therein for communication with the pressure outlet of the turbocharger, a second opening therein remote from the first opening;

an elongated rod interconnecting the housing and the waste gate exhaust valve through the second opening;

a mounting bracket pivotally connected to the housing adjacent the second opening and having an aperture therein for receiving the rod; and a fastener for selectively securing the mounting bracket to the housing such that with the fastener loosened the mounting bracket can pivot with respect to the housing and with the fastener tightened the mounting bracket is held in a fixed position with respect to the housing.

2. The actuator of claim 1 wherein the mounting bracket includes two generally opposing flange portions.

3. The actuator of claim 1 wherein the mounting bracket is substantially flat.

4. The actuator of claim 1 wherein the housing has a bottom end that is convex and through which the second opening extends.

5. The actuator of claim 1 wherein the housing has a bottom end through which the second opening extends and which includes a groove therein interconnecting a plurality of vent holes therethrough.

6. The actuator of claim 1 wherein the housing has a bottom end through which the second opening and a plurality of vent holes extend, the vent holes surrounding the second opening.

7. The actuator of claim 6 wherein the mounting bracket includes a body portion having an aperture therethrough and a pair of slots therethrough extending radially outward from the aperture so as to overlap at least one of the vent holes.

8. The actuator of claim 1 wherein the mounting bracket has a body portion and the housing and the body portion have complementary shapes for slidably engaging each other.

9. The actuator of claim 1 wherein the housing and the mounting bracket have mating curved surfaces such that the attitude of the mounting bracket with respect to the longitudinal axis of the housing is adjustable by tilting the mounting bracket angularly relative to the housing when the fastener is loosened.

10. The actuator of claim 1 further comprising a threaded member mounted in the second opening of the housing and having a hole therein for slidably receiving the rod, and wherein the fastener is a nut for threadingly engaging the threaded member.

11. The actuator of claim 1 wherein the housing includes first and second portions joined along a seam and a flat elastic diaphragm is clamped between the first and second housing portions at the seam, the diaphragm extends across the seam so as to divide the housing into first and second chambers respectively.

* * * * *